US008151497B2

(12) United States Patent
Wieieke

(10) Patent No.: US 8,151,497 B2
(45) Date of Patent: Apr. 10, 2012

(54) IDENTIFICATION DEVICE FOR ELECTRICAL CONDUCTORS

(75) Inventor: Andreas Wieieke, Lemgo (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 133 days.

(21) Appl. No.: 12/675,743

(22) PCT Filed: Aug. 22, 2008

(86) PCT No.: PCT/EP2008/006929
§ 371 (c)(1),
(2), (4) Date: Feb. 26, 2010

(87) PCT Pub. No.: WO2009/033558
PCT Pub. Date: Mar. 19, 2009

(65) Prior Publication Data

US 2010/0307039 A1 Dec. 9, 2010

(30) Foreign Application Priority Data

Sep. 7, 2007 (DE) ..... 20 2007 012 605 U

(51) Int. Cl.
*G09F 3/00* (2006.01)

(52) U.S. Cl. ..... 40/316; 24/501; 24/530

(58) Field of Classification Search ..... 40/316; 24/500, 501, 530, 132 R
See application file for complete search history.

(56) References Cited

U.S. PATENT DOCUMENTS

| | | | | | |
|---|---|---|---|---|---|
| 57,977 | A | * | 9/1866 | Sanborn | 24/501 |
| 160,840 | A | * | 3/1875 | Porter | 24/530 |
| 1,960,690 | A | | 5/1934 | Blair | |
| 2,615,221 | A | * | 10/1952 | Linton et al. | 24/501 |
| 2,871,538 | A | * | 2/1959 | Richardson | 24/530 |
| 3,060,536 | A | * | 10/1962 | La Voie | 24/346 |
| 3,096,551 | A | * | 7/1963 | Shoberg | 24/132 R |
| 3,778,868 | A | * | 12/1973 | Kelly | 403/361 |
| D410,573 | S | * | 6/1999 | McKibbin | D32/61 |

FOREIGN PATENT DOCUMENTS

| | | | |
|---|---|---|---|
| DE | 1826250 | U | 2/1961 |
| DE | 202007005563 | U1 | 8/2007 |
| EP | 0924712 | A | 6/1999 |
| WO | 9914728 | A | 3/1999 |

* cited by examiner

*Primary Examiner* — Gary Hoge
(74) *Attorney, Agent, or Firm* — Lawrence E. Laubscher, Sr.; Lawrence E. Laubscher, Jr.

(57) ABSTRACT

An identification device adapted for attachment to an insulated electrical conductor includes a pair of generally-rectangular marking plates having planar first longitudinal horizontal surfaces. A plurality of laterally-spaced resilient tension members connect together corresponding side portions of the marking plates, thereby to bias the marking plates toward a normally closed condition in which the marking plate first surfaces are in contiguous engagement. The marking plates are separable against the biasing force of the tension members toward an open condition for receiving longitudinally between the plates and the tension members the free end of a conductor. Upon release, the marking plates are displaced toward a clamping condition in parallel spaced longitudinally-arranged contiguous engagement with diametrically opposed circumferential surfaces of the conductor. The marking plates are pivoted to the open condition about a pivot axis defined by chamfered end surfaces of the plates.

8 Claims, 5 Drawing Sheets

Fig. 12
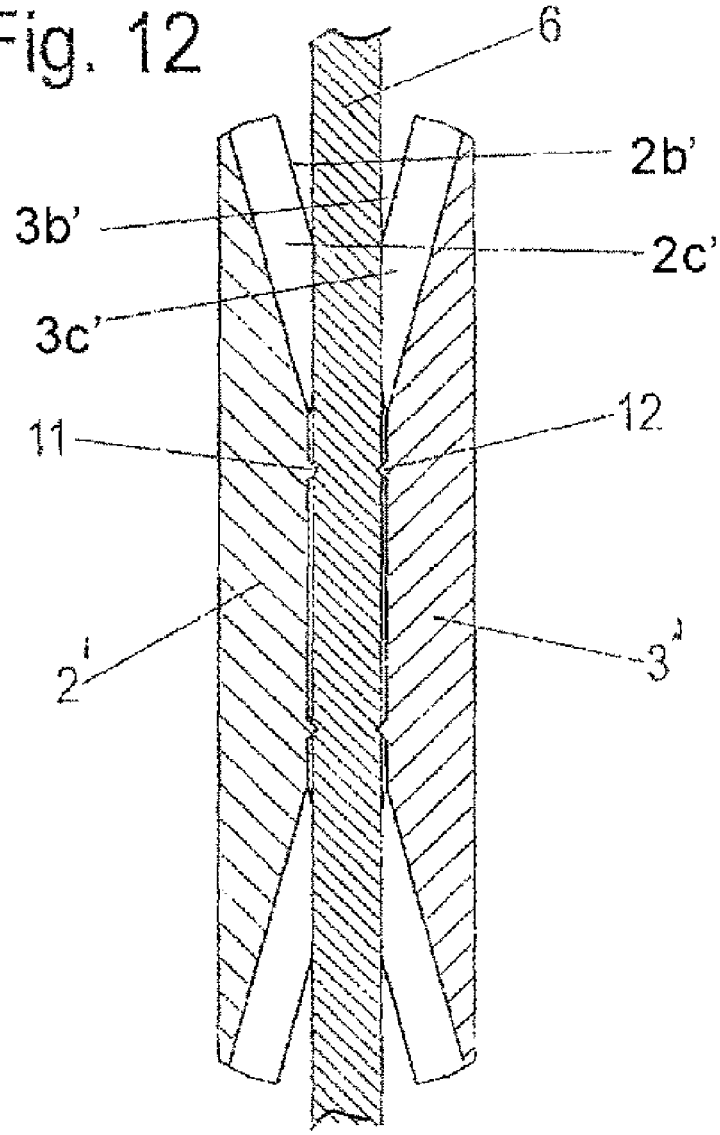
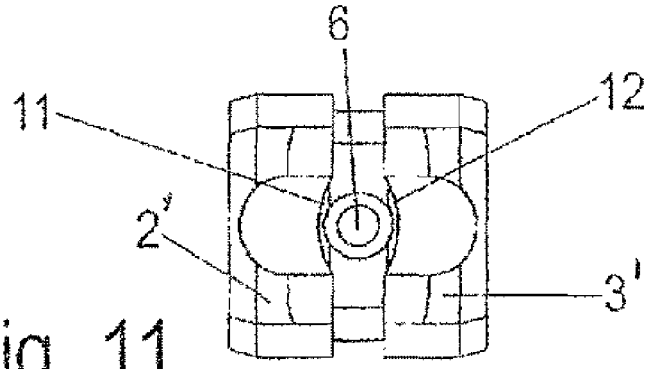
Fig. 11

IDENTIFICATION DEVICE FOR ELECTRICAL CONDUCTORS

REFERENCE TO RELATED APPLICATIONS

This application is a continuation of PCT Application No. PCT//EP2008/006929 filed Aug. 22, 2008 based on the German priority application No. 20 2007 012 605.0 filed Sep. 7, 2007, and published on Mar. 19, 2009 as International Published Application No. WO 2009/033558. This application is related to the inventor's pending U.S. application Ser. No. 12/675,320 filed Feb. 25, 2010.

BACKGROUND OF THE INVENTION

1. Field of the Invention

An identification device adapted for attachment to an insulated electrical conductor or cable includes a pair of generally-rectangular marking plates that are displaceable from a normally closed condition against the force of laterally-spaced tension means toward an open condition for longitudinally receiving the free end of a conductor, whereby upon release, the plates are biased toward a clamping condition in longitudinal contiguous engagement with diametrically opposed circumferential surfaces of the conductor.

2. Description of Related Art

It is well known in the patented prior art to provide indicia-bearing or color-coded marking devices for identifying power lines, insulated conductors, cables and the like. The marking plate can be equipped in many different ways, for example, one can write on it, or a label can be glued on it, or a label can be inserted in corresponding guides and can be firmly clamped.

Regardless of the particular model, the marking device should be attachable on the particular electric power line or conductor without any additional connecting elements or the like. It is attached, for example, by clamps or similar parts that build up restoring forces when placed upon the line.

The present invention was developed to provide marking device that increases the possibilities of marking as compared to known models and that the marking device can be placed upon the electric power line or conductor in the simplest fashion.

SUMMARY OF THE INVENTION

Accordingly, a primary object of the present invention is to provide an identification device adapted for attachment to an insulated electrical conductor, including a pair of generally-rectangular marking plates having planar first longitudinal horizontal surfaces, and a plurality of laterally-spaced resilient tension members connecting together corresponding side portions of the marking plates, thereby to bias the marking plates toward a closed condition in which the marking plate first surfaces are in contiguous engagement. The marking plates are separable against the biasing force of the tension members toward an open condition for receiving longitudinally between the plates and the tension members the free end of a conductor. Upon release of the marking plates, the marking plates are displaced toward a clamping condition in parallel spaced longitudinally-arranged contiguous engagement with diametrically opposed circumferential surfaces of the conductor.

According to a more specific object of the invention, the marking plates have a generally trapezoidal longitudinal cross-sectional configuration, with the corresponding ends of the marking plates having opposed oppositely-inclined chamfered surfaces that define pivot axes about which the parallel marking plates are pivoted during the movement thereof toward an angularly arranged open condition.

A further object is to provide tension members arranged on opposite side of the longitudinal axis of the marking plate assembly, each of the tension members being in the form of an endless generally-annular or polygonal member contained in a vertical plane parallel with the longitudinal axis of the assembly. The two marking plates are connected with each other by at least one flexible traction element arranged adjacent each longitudinal side of the assembly. Because of the provision of two marking plates, it is possible to use only one of the two marking plates for indicia-bearing purposes, although, if necessary, one could use both marking plates. These marking plates are connected with each other via several flexible traction elements; therefore, these two marking plates can be so positioned with respect to each other for purposes of placement against the electric power line that the line can be introduced between the two marking plates. In the process, the flexible traction elements are so impacted with traction stresses that the forces after contacting are still sufficient so that the marking device will not be shifted. Usually, the marking device is made of a synthetic plastic substance by an injection molding method. This can be done practicably in so-called multi-component injection molding processes so that the marking plates are dimensionally stable, while the flexible traction elements can be extremely stretched.

The marking device is so designed that in the unstressed state the marking plates will contact each other and that, when the electric power line is inserted, the marking plates will be at an interval with respect to each other at least in the area of the electric power line.

When the line lies between the two marking plates, the latter are elliptically deformed so that the terminal areas of the marking plates still rest against each other. This deformation causes restoring forces or clamping forces to be applied, which can ensure that the electric power line can no longer be shifted around.

Another embodiment provides that the marking plates are rectangular and that they be made with equal dimensions, whereby the lengths are greater than the widths.

A preferred embodiment provides that the marking plates to have a trapezoidal longitudinal cross-sectional configuration at least in mutually associated terminal areas as well as on the sides that face each other. This makes it possible for a user with one hand to press the two terminal areas together so that the opposite terminal areas will move away from each other, whereby the flexible traction elements are stressed. From this analogously open side, one can insert the electric power line into the marking device. The moment the final position has been reached, one lets go of the marking device on one side, and the stressed traction elements can be released and the parallel position of the two marking plates is assumed, whereby the flexible traction elements are under pre-stress conditions. For simple handling, however, it is provided that the terminal areas of both marking plates be wedge shaped so that one need no longer watch out to see which terminal areas are moved toward each other.

The marking plates may be provided on mutually facing sides with recesses so that the electric power line or conduit will lie within the marking device in the manner of a form-fitting lock. This guarantees adaptation to the circular shape of the power line. Moreover, no lateral forces are exerted upon the flexible traction elements.

To make sure that the marking device can be securely placed upon the electric power line, it is provided that on the two longitudinal sides of the marking plates there be positioned or molded on in each case at least two traction elements arranged at an interval with respect to each other.

An alternate embodiment provides the following. A closed endless annular resilient traction element is placed against or molded upon both longitudinal sides of the marking plates, whereby preferably each traction element is staggered with respect to the longitudinal edges of the marking plates. The traction elements extend over a relatively large area of the marking plates so that the necessary forces can be applied for the purpose of fixing the electric power line.

In this embodiment, it is then provided that the marking plates on the outer sides facing away from each other be provided with grooves that run parallel to and at an interval from the longitudinal edges of the marking plates in which grooves will engage the corresponding areas of each traction element. The traction elements are securely guided by the grooves. Each traction element is an endless traction element; it is therefore provided that boreholes be provided in the terminal areas of the grooves through which the traction elements can be extended.

For the additional fixation of the electric power line located between the marking plates, it is also provided that the mutually facing surfaces of the marking plates be provided with one or several bridges that run laterally with respect to the longitudinal sides of the marking plates. Since each marking plate is provided with several bridges, the latter are placed at an interval from each other. To make sure that these bridges can fit into the casing of the conductors in a permissible manner, it is provided that the bridges be made as cutting bridges.

The flexible traction elements must work like a rubber ring, although they can also be made of other materials. It is therefore provided that each flexible traction element be made as a closed ring. The always-present opening facilitates a particularly high degree of deformability. The outer contour of this ring can be polygonal.

In order additionally to increase safety against shifting the marking device with respect to the electric power line, it is provided that at least one marking plate on the side facing toward the other marking plate be provided with ribbings. Preferably, however, the mutually facing sides of both marking plates are provided with ribbings.

The traction elements should be so placed upon or molded upon the marking plates that they cannot be lost. In a simplest embodiment, this is achieved by having each traction element undercut an undercutting or be guided through an opening.

To make sure that the two marking plates cannot be mutually shifted, it is provided that at least the two marking plates on one longitudinal side have in each case have a protruding sharp projection. This projection defines an edge against which the two marking plates will be supported. In another embodiment, however, a protruding bridge can be arranged in each case on the two longitudinal sides of the marking plates.

Regardless of the shape of the marking plates, the marking device should be so designed that a passage opening will be made if the two marking plates are moved in opposite directions. As the marking device is closed, the traction elements are released so that this passage opening will close so far that the electric power line will be firmly clamped.

BRIEF DESCRIPTION OF THE DRAWINGS

Other objects and advantages of the invention will become apparent from a study of the following specification, when viewed in the light of the accompanying drawing, in which:

FIGS. 11 and 12 are end and top plan views of the apparatus in the clamping condition of FIG. 6.

DETAILED DESCRIPTION OF THE INVENTION

Figure 2:
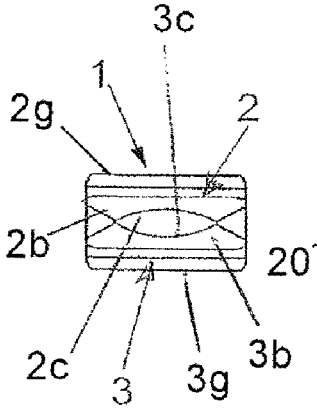
FIG. 2 is an end view of the apparatus of FIG. 1.
Figure 1:
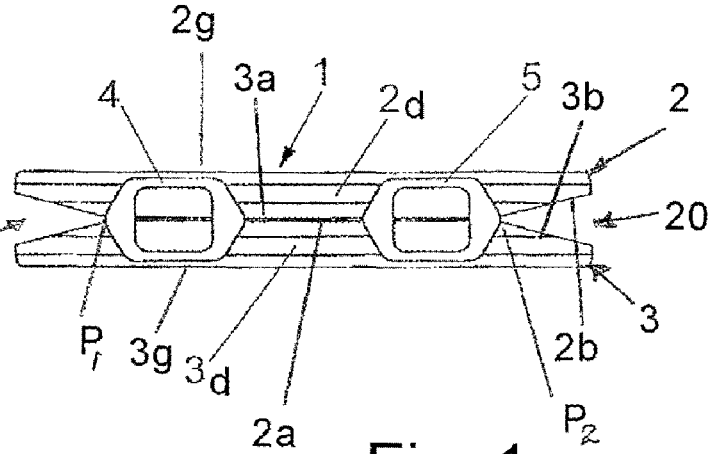
FIG. 1 is a side elevation view of a first embodiment of the identification device of the present invention when in the closed condition.
Figure 3:
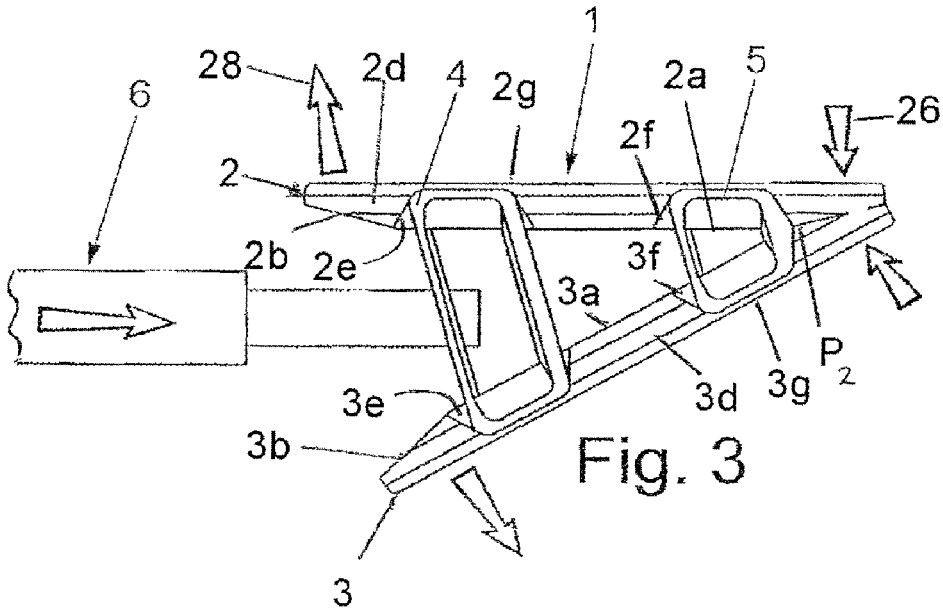
FIG. 3 is a side view of the apparatus of FIG. 1 in the open condition.

Referring first more particularly to FIGS. 1-3, the marking device 1 includes a pair of relatively rigid marking plates 2 and 3 having planar horizontal first surfaces 2*a*, 3*a* that are in engagement when the marking plates are in the parallel closed condition of FIGS. 1 and 2. The marking plates are connected together by traction means including a plurality of endless generally-polygonal resilient traction members 4 and 5, thereby to define a marking plate assembly. The traction members are arranged on opposite sides of the longitudinal axis of the marking plate assembly for biasing the marking plates together toward the closed condition of FIGS. 1 and 2.

The marking plates have trapezoidal longitudinal cross-sectional configurations in which the first surfaces 2*a*, 3*a* form the shorter longitudinal sides of the plate, and to which the chamfered end surfaces 2*b* and 3*b* are connected at an obtuse angle. The chamfered end surfaces contain centrally-arranged longitudinal grooves 2*c* and 3*c*, as shown in FIG. 2. The marking plates also include vertical side wall surfaces 2*d* and 3*d*, and longer horizontal longitudinal walls 2*g* and 3*g* parallel with the first wall surfaces 2*a*, 3*a*. The side walls 2*d* and 3*d* on both sides of the plates contain corresponding first external grooves 2*e*, 3*e* (FIG. 3) that receive portions of the two laterally-spaced tension members 4 at one end of the assembly, and second external grooves 2*f* that receive portions of the two laterally-spaced tension members 5 at the other end of the assembly.

Figure 10:
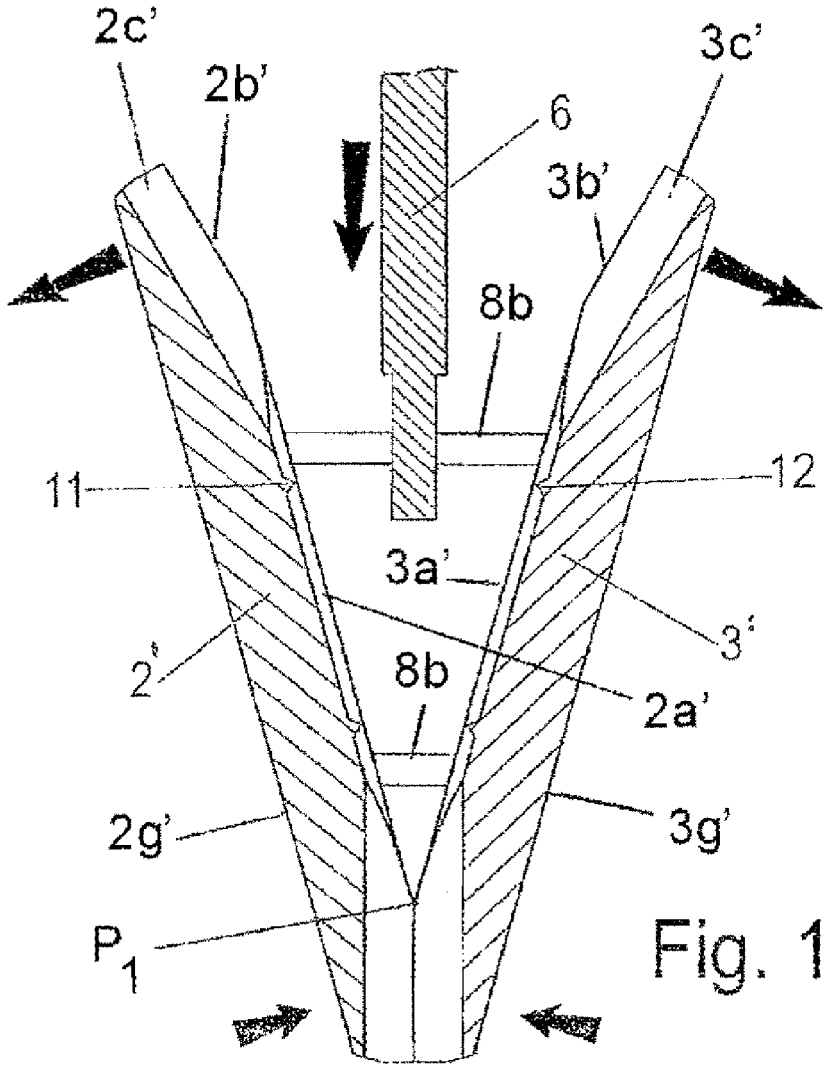
FIGS. 9 and 10 are end and top plan views, respectively, of the apparatus in the open condition of FIG. 5.
Figure 9:
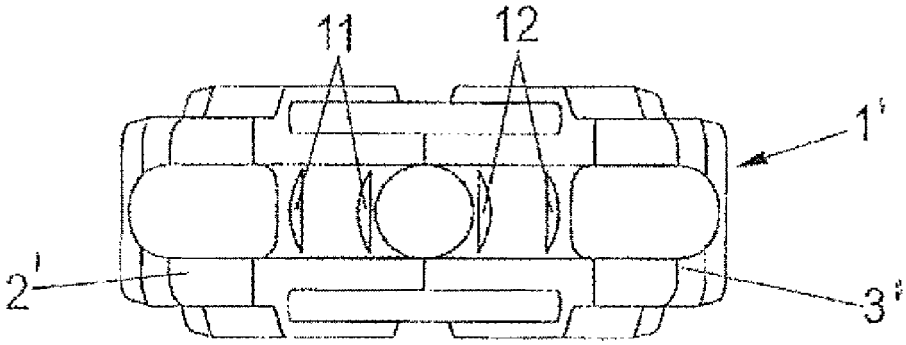

As shown in FIG. 1, the apices of the obtuse angles defined between the chamfered end surfaces 2*b* and 3*b* and the first surfaces 2*a* and 3*a*, respectively, define transverse pivot axes $P_1$ and $P_2$ at opposite ends of the marking plate assembly. Consequently, when the right hand ends of the marking plates are squeezed together as shown by the arrows 26 in FIG. 3, plates are pivoted apart about pivot axis $P_2$, as shown by the arrows 28, toward the illustrated angularly-arranged open condition. The free end of the conductor or cable 6 may then be longitudinally introduced between the plates and between the laterally space pairs of tension members 4 and 5. The conductor 6 is inserted longitudinally to any desired amount within the marking device, and even completely through the device against the biasing force of the tension members in a manner similar to that shown in FIGS. 6. In this case, the opening defined between the groove 2*c* and 3*c* (FIG. 2) assists in inserting the conductor completely through the marking device in a manner similar to that shown in FIG. 10.

Referring now to the alternate embodiment of FIGS. 4-12, the traction members in this case comprise two endless generally-annular members 7 and 8 contained in parallel vertical planes on opposite sides of the longitudinal axis of the marking plate assembly. The traction members include horizontal first runs 7*a* and 8*a* contained in longitudinal grooves 9 and 10 formed in the outer horizontal longitudinal first surfaces 2*g*' and 3*g*' of the marking plates 2' and 3', respectively. The traction members include vertical runs 7*b* and 8*b* that extend through aligned vertical bores 22 (FIG. 5) contained in the marking plates 2' and 3', respectively. The traction members 7 and 8 bias the marking plates toward the normal closed condition of FIGS. 4, 7 and 8.

Referring again to FIG. 3, it will be seen that the traction elements 4 facing toward the electric power line 6, are definitely more heavily stressed than the traction elements 5 that face away from electric power line 6. At the latest when the free front end of electric power line 6 abut the internal surfaces of marking plates 2, 3, the pressure force is reduced so that traction elements 4 will be released and, as a result, marking plates 2, 3 will be moved toward each other. Traction elements 4, 5 are still under pressure at that time; therefore, marking device 1 is retained on electric power line 6 so that it cannot be lost.

As shown especially in FIG. 2, the mutually facing surfaces of marking plates 2, 3 are provided with recesses that are arched. As a result, the inserted electric power line 6 is guided so that no lateral forces can act upon the flexible traction elements 4, 5.

Figure 6:
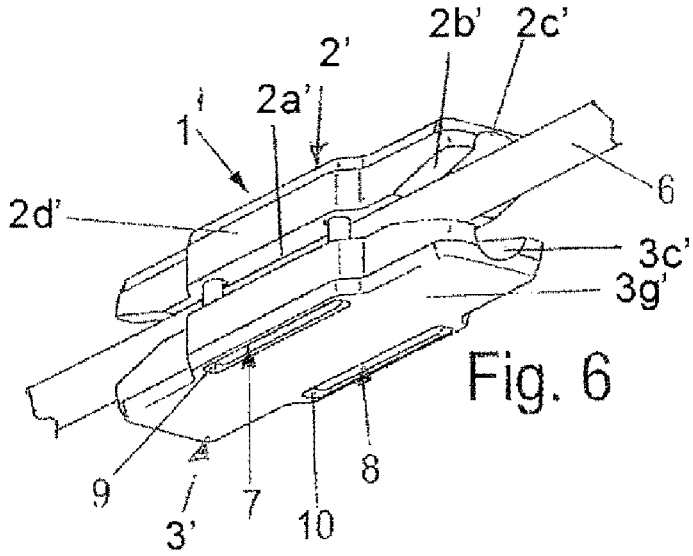
FIG. 6 is a perspective view of the identification device of FIG. 4 in the clamping condition relative to an electric conductor.
Figure 5:
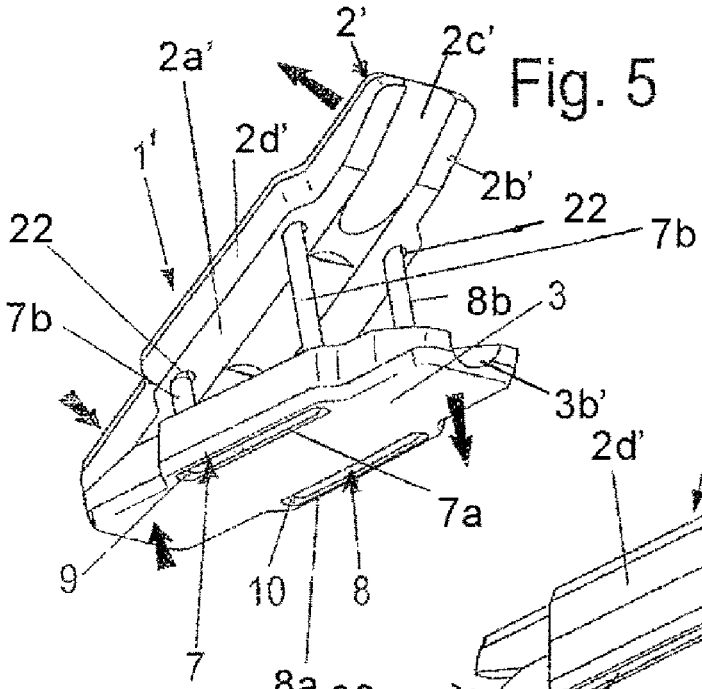
FIG. 5 is a perspective view of the identification device of FIG. 4 when in the open condition.
Figure 4:
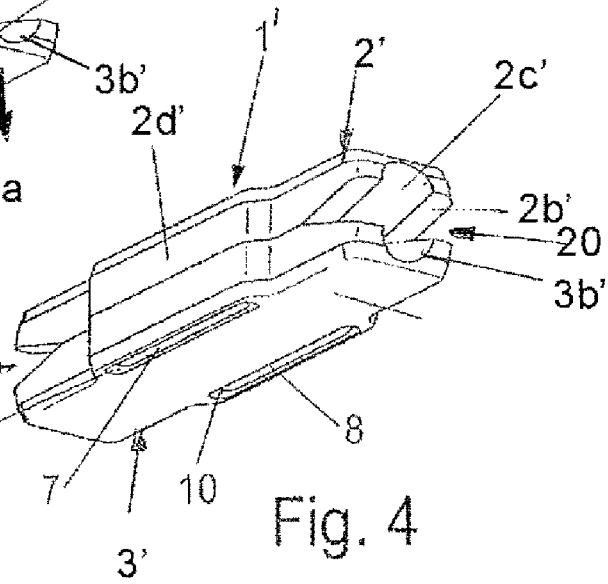
FIG. 4 is a bottom perspective view of a second embodiment of the invention when in the closed condition.

FIG. 4 shows that the marking plates 2, 3 rest against each other when the power line is not inserted. A pressure upon a terminal area causes the flexible traction elements 7, 8 to be stressed because the marking plates 2, 3 are at an acute angle with respect to each other. This position is shown especially in FIG. 5 in conjunction with FIG. 10. Then power line 6 can be introduced into the marking device 1. As shown in FIG. 6, power line 6 can also lie on both sides of marking device 1. The mutually facing surfaces of marking plates 2, 3 are then at an interval from each other. The traction forces, applied by the flexible traction elements 7, 8, are so great that a shifting of the marking device 1 in the longitudinal direction of line 6 can be achieved, if at all, then only with relatively heavy force. The figures also show that the marking device 1, according to FIGS. 4 to 12, is designed for conductors or power lines having different diameters.

Figure 8:
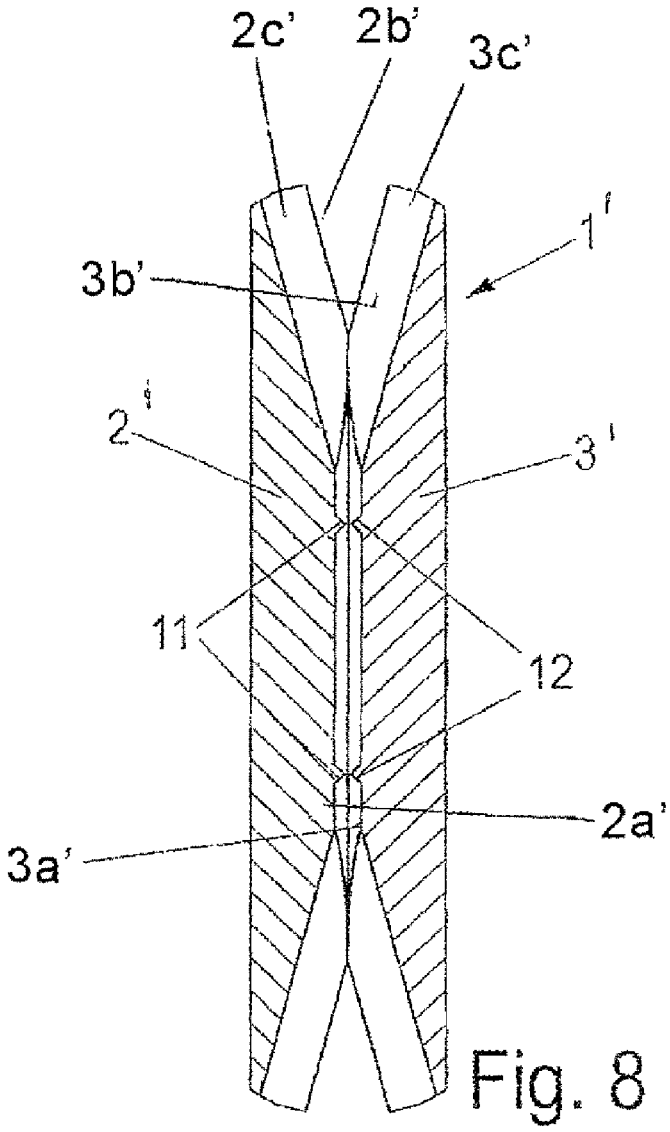
FIGS. 7 and 8 are end and top plan views, respectively, of the apparatus in the closed condition of FIG. 4.
Figure 7:
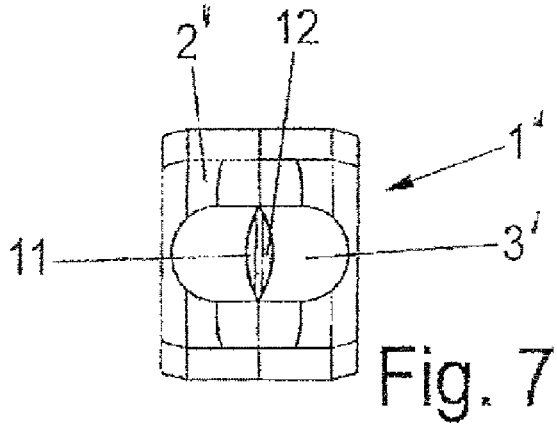

FIGS. 7 and 8 show that when the power line is not inserted, the mutually facing surfaces in the middle area are at an interval from each other because these surfaces are provided with projections 11, 12 that extend laterally with respect to the longitudinal edges. These projections 11, 12 have a triangular cross-section and accordingly define sharp edges that partially cut into the outer insulation layer of power line 6, as shown in FIG. 12.

In a manner not shown, one of the two marking plates 2 or 3 or both marking plates on the side facing toward the other marking plate or on the two mutually facing sides could be provided with ribbings. Traction elements 4, 5 are arranged on marking plates 2, 3 so that they cannot be lost. This could be done, for example, by putting or placing undercuts upon the marking plates 2, 3, which undercuts are, in turn, undercut by traction elements 4, 5. Alternately, it is also possible to provide each marking plate 2, 3 with at least one opening through which traction element 4 or 5 extends.

In a manner likewise not illustrated, marking plates 2, 3 in each case could be provided with a protruding projection on at least one longitudinal side, which projections would support each other so that one can prevent a lateral shifting of the marking plates 2, 3. In the preferred embodiment, however, marking plates 2, 3 are on both longitudinal sides provided with one protruding bridge each. When the two marking plates 2, 3 are analogously open in that they are moved in opposite directions, then one gets a passage opening. After the insertion of the electric power line, this passage opening is opened by the relaxation of the traction elements and this passage opening is again partly closed according to the cross-section of the electric power line.

The invention is not confined to the illustrated exemplary embodiment. The essential thing is that the two marking plates 2, 3 of the marking device 1 are connected with each other via flexible traction elements 4, 5 so that after the insertion of the electric power line 6, the marking plates 2, 3 will be fixed upon electric power line 6 by traction forces.

While in accordance with the provisions of the Patent Statutes the preferred forms and embodiments of the invention have been illustrated and described, it will be apparent to those skilled in the art that changes may be made without deviating from the invention described above.

What is claimed is:

1. An identification device adapted for mounting on the free end of an insulated conductor, comprising:

(a) a pair of generally-rectangular marking plates (2, 3; 2', 3'), each of said marking plates having a generally trapezoidal longitudinal cross-sectional configuration including:

(1) a pair of horizontal parallel spaced longitudinal walls (2*a*, 2*g*; 3*a*, 3*g*); and (2) chamfered walls (2*b*; 3*b*) at the ends of each plate, whereby one of said longitudinal walls (2*g*; 3*g*) is longer than the other longitudinal wall (2*a*; 3*a*);

(3) said marking plates being relatively longitudinally rotated and initially arranged in a parallel closed condition with their shorter walls in contiguous engagement; and (b) tension means biasing said marking plates together toward said closed condition, thereby to define a marking plate assembly, said chamfered walls forming divergent slots (20) at the ends of the marking plate assembly, the apices of the obtuse angles between said chamfered walls and the associated shorter longitudinal walls defining transverse pivot axes ($P_1$, $P_2$; $P_1'$, $P_2'$) at the apices of said slots, respectively, said tension means including tension members (4, 5; 7, 8) arranged on opposite sides of the longitudinal axis of said marking plate assembly adjacent the longitudinal side portions of said marking plates;

(c) said plates being pivotally displaceable apart against the force of said tension means about the pivot axes at one end of said marking plate assembly from said closed condition toward an open condition in which said marking plates are arranged at an acute angle, whereby said marking plates are adapted to receive longitudinally therebetween the free end of a conductor (6), each of said chamfered surfaces containing a centrally-arranged longitudinal groove 2*c*, 3*c*; 2*c*', 3*c*') adapted to receive a circumferential portion of the conductor when said marking plates are in said open condition;

(d) said marking plates being biased by said tension means such that upon release of the marking plates, said marking plates are displaced from said open condition toward a clamping condition in which said marking plates are adapted for parallel spaced longitudinal contiguous engagement with diametrically opposed circumferential surfaces of the conductor.

2. An identification device as defined in claim 1, wherein at each end of said marking plate assembly at least two of said tension members (4, 5) are connected between corresponding marking plate side portions in opposed laterally-spaced relation.

3. An identification device as defined in claim 2, wherein each of said tension members comprises an endless polygonal resilient member (4, 5); and further wherein said marking plates include vertical side walls (2*d*, 3*d*) that extend normal to said longer longitudinal walls, said side walls having outer surfaces containing corresponding external vertical grooves (2*e*, 3*e*; 2*f*, 3*f*) for receiving diametrically-opposed portions of said resilient members, respectively.

4. An identification device as defined in claim 1, wherein said tension members comprise endless polygonal resilient members (7, 8) contained in vertical planes extending longitudinally of said marking plate assembly on opposite sides of the longitudinal axis of said marking plate assembly, each of said resilient members including horizontal first portions7*a*, 8*a*) extending longitudinally adjacent said marking plate longer longitudinal walls, respectively, and vertical second portions (7*b*, 8*b*) extending through opposed vertical bores (22) contained in the side portions of said marking plates.

5. An identification device as defined in claim 4, wherein said marking plate longer longitudinal walls contain longitudinal grooves (9, 10) receiving said tension member horizontal first portions.

6. An identification device as defined in claim 1, wherein the adjacent surfaces of said marking plate include a plurality of longitudinally-spaced integral projections adapted to engage the circumferential surface of the conductor when said marking plates are in said clamping condition, thereby to prevent relative longitudinal displacement between said marking plate assembly and the conductor.

7. An identification device as defined in claim 6, wherein at each end of said marking plate assembly said projections (11, 12) are pointed to define sharp edges adapted for gripping engagement with the insulation layer of the conductor.

8. An identification device as defined in claim 6, wherein said projections comprise transverse ribs.

* * * * *

UNITED STATES PATENT AND TRADEMARK OFFICE

CERTIFICATE OF CORRECTION

PATENT NO. : 8,151,497 B2
APPLICATION NO. : 12/675743
DATED : April 10, 2012
INVENTOR(S) : Andreas Wieneke It is certified that error appears in the above-identified patent and that said Letters Patent is hereby corrected as shown below:

Title Page, Item (12), delete "Wieike" and insert -- Wieneke --.

Title Page, Item (75) Inventors: Correct the Inventor's name to read: -- Andreas Wieneke --.

Signed and Sealed this
Thirty-first Day of July, 2012

David J. Kappos

David J. Kappos
*Director of the United States Patent and Trademark Office*